US005286299A

United States Patent [19]

Milner

[11] Patent Number: 5,286,299

[45] Date of Patent: Feb. 15, 1994

[54] APPARATUS AND METHOD FOR PROVIDING REDUCED CRYSTAL DAMAGE IN A SUGAR CENTRIFUGAL

[75] Inventor: Ted D. Milner, Westminster, Colo.

[73] Assignee: Silver Engineering Works, Inc., Aurora, Colo.

[21] Appl. No.: 807,284

[22] Filed: Dec. 13, 1991

[51] Int. Cl.[5] ..... C13F 1/06; B04B 15/00; B04B 3/00

[52] U.S. Cl. ..... 127/17; 127/19; 127/56; 210/781; 210/369

[58] Field of Search ..... 127/17, 19, 56; 210/781, 787, 360.1, 406, 369

[56] References Cited

U.S. PATENT DOCUMENTS 3,050,190 8/1962 Siepe ..... 210/380.1
3,403,785 10/1968 Mercier ..... 210/369
3,490,947 1/1970 Grieselhuber ..... 127/19
4,033,879 7/1977 Natt et al. ..... 127/56

*Primary Examiner*—R. Bruce Breneman
*Assistant Examiner*—P. L. Hailey
*Attorney, Agent, or Firm*—Robert F. Palermo

[57] ABSTRACT

An apparatus and method for providing reduced crystal damage in a sugar centrifugal includes provisions for avoiding scratching and other crystal damage by eliminating asperities and sharp edges at the transition between the screening zone and the discharge zone of a centrifugal basket. In addition, the distance on an upper shroud ring across which high velocity crystals slide is minimized to reduce the likelihood of scratching crystals on the surface of the shroud ring. Finally, the tangential velocity at which crystals are released from the centrifugal basket is minimized to reduce impact damage to the crystals.

12 Claims, 1 Drawing Sheet

APPARATUS AND METHOD FOR PROVIDING REDUCED CRYSTAL DAMAGE IN A SUGAR CENTRIFUGAL

BACKGROUND OF THE INVENTION

This invention relates generally to sugar making machinery and more particularly to devices and methods for achieving improvements in sugar centrifugals which provide decreased sugar crystal damage.

Sugar making requires several operations for separating massecuite into sugar crystals and molasses (or runoff), its two components. In all cases except for separation of high grade sugar crystals, the crystals are remelted and further refined. The quality and integrity of the crystals after separation is therefore of minimal consequence except in the case of high grade sugar.

Broken crystals require downgrading of sugar product, and they must, therefore, be avoided. However, the viscosity of the molasses component of the massecuite requires centrifugal separation in order to free the sugar crystals of the surrounding syrup. The high discharge velocity and resultant high gravity forces imposed on the massecuite by the centrifugals frequently results in excessive damage to the high grade crystals.

This damage is frequently attributable to fracture of crystals which have been weakened by scratching and scoring so that they easily cleave when subjected to impact contacts with surfaces inside of the sugar housing or with other crystals.

The scratching commonly occurs when the crystal reaches the top of the centrifugal basket, passes over the basket rim, and slides across the upper shroud ring. The passage of crystals over the basket rim to the shroud ring exposes them to sharp edges which can scratch the crystals as they pass. Also, some shroud rings have projecting fasteners against which the crystals may impact in addition to surface asperities against which crystals may be scratched or scored. The crystals, thus scratched, have an increased probability of fracture during any subsequent contact, whether with shroud fasteners, housing members or other crystals.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus and method for reducing sugar crystal damage in a sugar centrifugal including annular means, free of asperities, between a screening surface and a crystal release line of a discharge surface for reducing the discharge velocity of the sugar crystals and the distance over which the crystals slide during discharge.

The foregoing and other aspects will become apparent from the following detailed description of the invention when considered in conjunction with the accompanying drawing figures.

BRIEF DESCRIPTION OF THE DRAWING FIGURES

FIG. 1 is fragmentary partially sectional view illustrating features of a typical sugar centrifugal; and FIG. 2 is a fragmentary cross sectional view of a preferred embodiment of the present invention.

DETAILED DESCRIPTION

Figure 1:
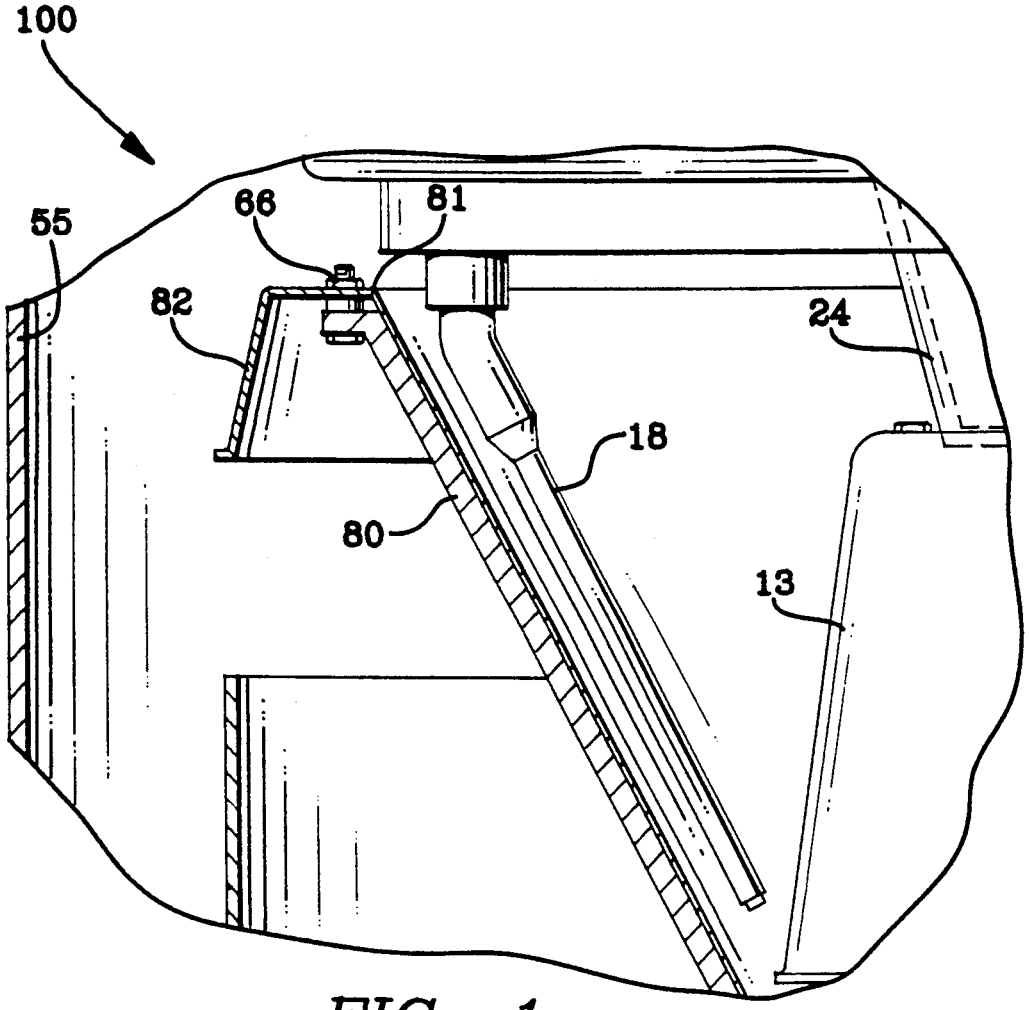

FIG. 1 shows significant features of a typical sugar centrifugal 100. Sugar housing 55 is the lateral wall of centrifugal 100 surrounding centrifugal basket 80 which rotates at high speed. Massecuite is introduced through feed inlet 24 into accelerator bell 13 which imparts rotary motion to the massecuite and distributes it about the bottom portion of basket 80. Centrifugal forces drive the massecuite up the inner screening of basket 80 which has a perforated screen surface, not shown, through which the molasses is drained from the sugar crystals which pass upward on the basket. Rinse nozzles 18 provide a water spray to facilitate molasses removal. At the top of basket 80, the crystals pass over basket rim 81 onto a crystal discharge surface of an annular upper shroud ring 82 and slide to the outer edge where they are discharged outwardly to sugar housing 55. Damage to the sugar crystals is usually due to passing over rim 81, sliding across shroud ring 82, colliding with shroud fasteners 66, and impacting against sugar housing 55 or against other crystals.

Figure 2:
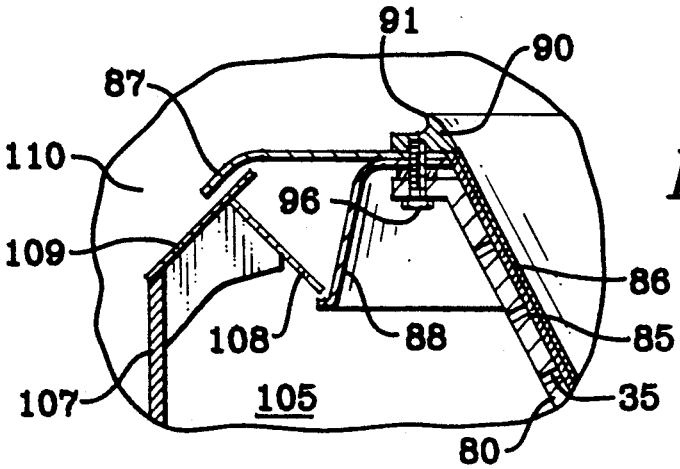

FIG. 2 shows a portion of a centrifugal basket incorporating a preferred embodiment of the present invention. Basket 80 has a screening surface made up of a backup screen 85 covered by fine working screen 86. During centrifugal separation, sugar crystals, too coarse to pass through the perforations of fine working screen 86, travel upwards on the screen to crystal saver ring 90 which is mounted on he crystal discharge surface of the annular upper shroud ring 87. Molasses which passes through fine working screen 86, back-up screen 85, and drain holes 35 in basket 80, flows into molasses chamber 105 and is ultimately drained to a molasses tank, not shown. At the top of chamber wall 107, which separates molasses chamber 105 from sugar chamber 110, are molasses seal 108 and sugar seal 109, which are projecting rings that, in cooperation with lower shroud ring 88 and upper shroud ring 87, respectively, form a labyrinth seal between the two chambers. This seal makes any flow between the two chambers very improbable.

Fasteners 96, which connect basket 80 to lower shroud ring 88, upper shroud ring 87, and crystal saver ring 90, are recessed or hidden so that they cannot scratch crystals passing over upper shroud ring 87 and crystal saver ring 90. Crystal saver ring 90 has a radius which blends smoothly with fine working screen 86 to reduce the likelihood of crystal scratching at the juncture of the two members. The crystal discharge surface is that surface of the centrifugal basket with which the sugar crystals have their final contact before being centrifugally discharged from the basket.

The smooth inner radius surface of crystal saver ring 90 flares to its crystal release line 91 which is just inside the outermost edge of crystal saver ring 90. Thus, probability of crystal scratching while passing over the basket rim is significantly reduced. Location of crystal release line 91 above the highest point on upper shroud ring 87 also makes the likelihood of crystal damage due to sliding across shroud ring 87 vanishingly small, because the likelihood of contact of crystals with the shroud ring is very slight.

Finally, crystal release line 91 is also of smaller diameter than the outer edge of upper shroud ring 87, and, therefore, it releases the crystals at a lower tangential velocity than would upper shroud ring 87. This is a significant improvement, since, at speeds as high as 2400 rpm, a decrease of one inch in the radius at which release occurs results in a decrease of approximately 20 feet per second in the tangential velocity of the crystals. Impact damage to the crystals upon hitting sugar housing wall 55 (FIG. 1), is decreased proportionately with the decrease in velocity attributed to the decreased radius of crystal release line 91.

What is claimed is:

1. An apparatus for reducing sugar crystal damage in a sugar centrifugal, comprising:

annular means at a top rim of a centrifugal bake for reducing incidence of crystal damage during passage of crystals from a screening surface of said centrifugal basket to a crystal discharge surface of an upper shroud ring, said annular means comprising a ring, free of asperities, between said screening surface and a crystal release line of said discharge surface.

2. The apparatus of claim 1, further comprising:

means for reducing a distance, on said crystal discharge surface of said upper shroud ring, over which high speed crystals slide during discharge from said centrifugal basket.

3. The apparatus of claim 2, wherein the means for reducing a distance over which high speed crystals slide comprises a crystal saver ring mounted on an upper shroud ring; said crystal over ring having a crystal release line at an elevation higher than any portion of said upper shroud ring.

4. The apparatus of claim 3, wherein the crystal release line has a radius smaller than that of any other portion of the discharge surface of the upper shroud ring.

5. The apparats of claim 2, wherein the means for reducing a distance over which high speed crystals slide during discharge comprises a crystal saver ring having a crystal release line at an elevation higher and a radius smaller than that of any of the portion of the discharge surface of the upper shroud ring.

6. The apparatus of claim 1, further comprising:

means for reducing the tangential velocity at which crystals are discharged from said discharge surface.

7. The apparatus of claim 6, wherein the means for reducing the tangential velocity comprises a crystal saver ring have a crystal release line at a radius smaller than that of any other portion of the discharge surface of the upper shroud ring.

8. A method for reducing incidence of sugar crystal damage during discharge of crystals from a centrifugal basket in a sugar centrifugal, comprising the steps of:

eliminating asperities at a transition between a screening portion and a discharge portion of said centrifugal basket by mounting a crystal saver ring having a smooth inner radius surface upon said discharge portion above said screening portion of the basket.

9. The method of claim 8 including the further step of:

reducing the distance on the discharge portion over which high speed crystals slide during discharge from said centrifugal basket.

10. The method of claim 9, wherein the step of reducing the distance on the discharge portion over which high speed crystals slide is accomplished by providing a crystal release lien at a location on said crystal wavier ring having an elevation higher than that of any other part of the discharge portion and a location at an inboard section of said discharge portion.

11. The method of claim 9, including the further steps of:

reducing the tangential velocity at which crystals ar discharged from said centrifugal basket.

12. The method of claim 11, wherein the step of reducing the tangential velocity is accomplished by providing a crystal release line at a portion of a discharge region having a minimum radial location.

* * * * *